United States Patent [19]

Ripley-Lotee et al.

[11] 4,364,530

[45] Dec. 21, 1982

[54] PROPULSION/CONTROL MODULAR BOOSTER

[75] Inventors: Michael J. Ripley-Lotee, China Lake; Robert B. Dillinger; Keith E. Clark, both of Ridgecrest, all of Calif.

[73] Assignee: The United States of America as represented by the Secretary of the Navy, Washington, D.C.

[21] Appl. No.: 184,823

[22] Filed: Sep. 8, 1980

[51] Int. Cl.[3] ..... F42B 15/02; F42B 15/12; F02K 1/20

[52] U.S. Cl. ..... 244/3.22; 60/230; 102/378

[58] Field of Search ..... 244/3.21, 3.22; 60/228, 60/230, 231; 102/378; 75/200

[56] References Cited

U.S. PATENT DOCUMENTS

| | | | |
|---|---|---|---|
| 2,984,157 | 5/1961 | Johnstone | 89/45 X |
| 3,121,312 | 2/1964 | Hopper | 60/231 |
| 3,260,204 | 7/1966 | Wilkey | 244/3.22 |
| 3,396,920 | 8/1968 | Rosen et al. | 244/3.22 X |
| 3,743,184 | 7/1973 | Mancus | 60/230 X |
| 3,803,387 | 4/1974 | Lackowski | 89/41 D X |
| 3,903,803 | 9/1975 | Losey | 102/378 |
| 3,929,424 | 12/1975 | Krock et al. | 75/200 X |
| 4,123,265 | 10/1978 | Takahashi et al. | 75/200 X |
| 4,131,246 | 12/1978 | Rotmans | 60/230 X |
| 4,274,610 | 6/1981 | Bastian | 244/3.22 |

*Primary Examiner*—David H. Brown

*Attorney, Agent, or Firm*—R. F. Beers; W. Thom Skeer; Kenneth G. Pritchard

[57] ABSTRACT

A modular, apogee-control package is disclosed which can be added to existing missiles, and which will limit the apogee of the missile trajectory by implementation of thrust vector control (TVC). The package comprises a boost guidance unit, a solid rocket propellant motor, and jet vane TVC.

1 Claim, 7 Drawing Figures

PROPULSION/CONTROL MODULAR BOOSTER

BACKGROUND OF THE INVENTION

1. Field of the Invention

This invention relates to a device that adds extra capabilities to guided missiles. More particularly, the device minimizes trajectory apogees of a guided missile, by providing a booster which utilizes three-axis thrust vector control (TVC).

2. Description of the Prior Art

Some prior art missiles fly a ballistic trajectory enroute to their target to allow aerodynamic control by missile wings after booster separation. This results in high trajectories and possible detection of the launch vessel because the missile penetrates the adverse radar horizon at a distance in excess of the missile's maximum cruise range capability.

One other limitation limited prior art missiles: the requirement for active roll control immediately after launch. Aerodynamic control employing existing aerodynamic control surfaces cannot achieve the necessary control in the pitch and yaw modes that the missile requires upon launch. The missile velocity, and the resulting dynamic pressure, are too low to achieve necessary control.

SUMMARY OF THE INVENTION

An apogee-control booster for installation on a guided missile consists of a three-axis, jet vane, thrust vector control (J-V TVC) unit; a rocket motor and solid propellant; and a booster guidance unit (BGU). All three modules are incorporated into one clamp-on package that will allow a naval missile to be launched from either a submarine or a surface vessel at any desired angle.

The J-V TVC unit uses velocity-independent pitch, yaw, and roll control to minimize the missile's apogee by initially pitching it very sharply immediately after launch. The actual jet vanes can be copper-infiltrated tungsten or ceramic-coated stainless steel or other materials.

The BGU provides guidance and control of the missile during the boost phase, as well as controlling the jet vanes. The BGU uses rate gyroscopes to sense angular motions of the missile and a direction cosine algorithm to determine missile attitude and/or position. Accelerometers can also be added to determine missile position if necessary. In addition, the BGU provides an active interface between the missile guidance unit and the launch vessel's fire control system.

OBJECTS OF THE INVENTION

An object of the invention is to substantially limit the apogee of a naval-launched missile by addition of an apogee control package to said missile.

A further object of the invention is to provide surface vessels with the capability of launching an apogee-controlled missile at a variable angle of from 90° to horizontal (0°).

A further object of the invention is to provide a submarine-launched, apogee-controlled missile with a vertical broach capability.

These and other objects of this invention will appear from the following specification, and are not to be construed as limiting the scope of the invention thereto, since in views of the disclosure herein, others may be able to make additional embodiments within the scope of the appended claims.

DESCRIPTION OF THE PREFERRED EMBODIMENT

Figure 1:
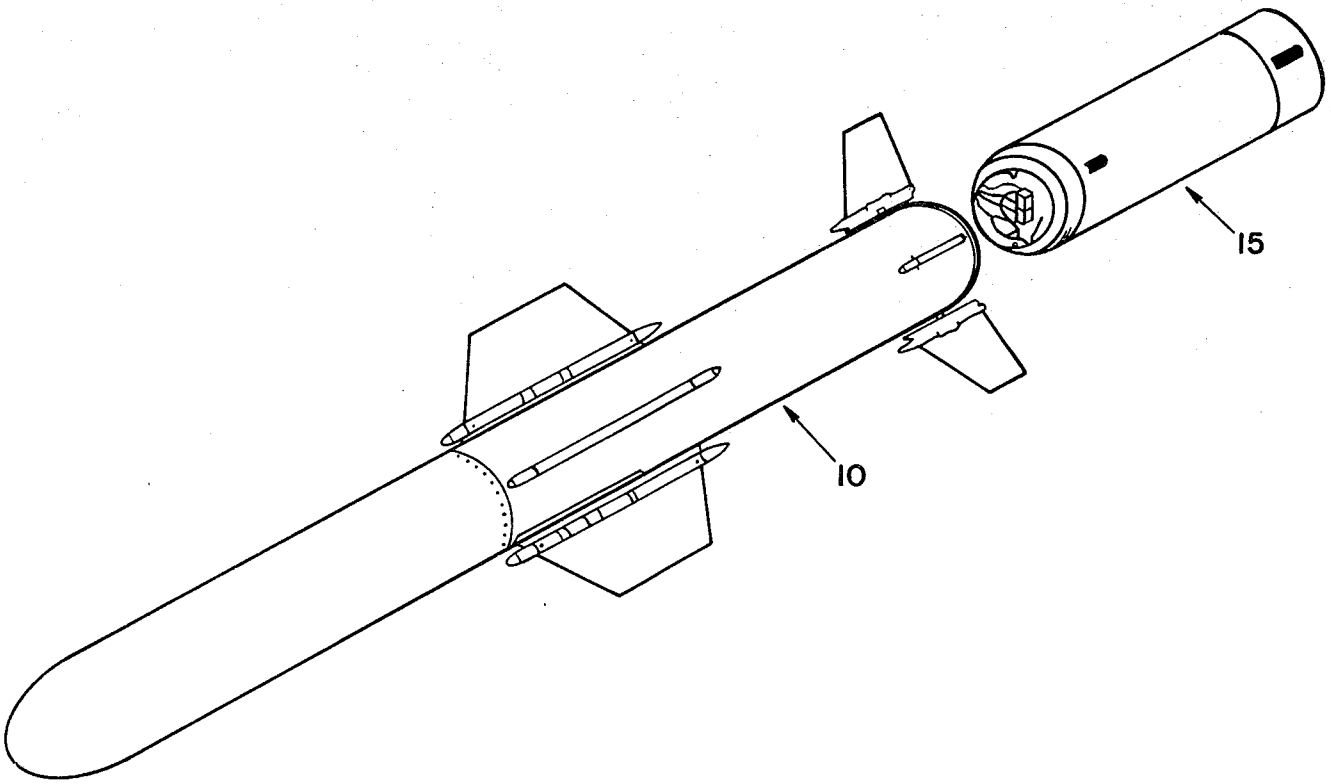
FIG. 1 is a perspective view of a guided missile and the invention.
Figure 2:
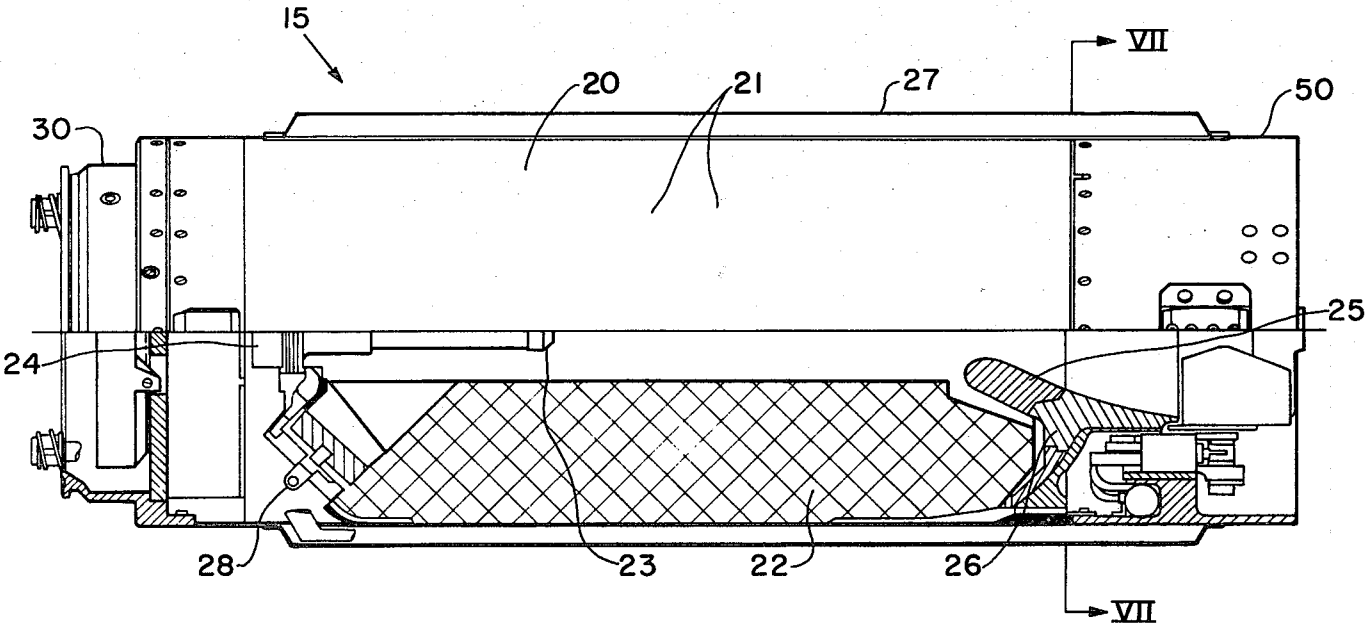
FIG. 2 is a side view of the invention with a partial cut-away of the booster shroud.

FIG. 1 is a perspective view of a guided missile 10 and apogee control booster 15. FIG. 2 shows a side view of booster 15, which is composed of three major components: a rocket motor/solid propellant module 20, a boost guidance unit (BGU) 30, and a thrust vector control (TVC) unit 50. Guided missile 10 may either be submarine launched or surface vessel launched, and may be the type to normally carry its onw missile guidance unit (MGU) that receives initial commands from the launch vessel's fire control system.

FIG. 2 shows a side view of booster 15 and details of rocket motor/solid propellant module 20. Module 20 is of the type normally found in the rocket industry. A rocket shroud 21 encircles the internal components and provides the structural backbone of module 20. The lower half of shroud 21 is cut away in FIG. 2 to show the internal parts of module 20.

Module 20 is of the standard, tubular shape and has a propellant grain 22 cast inside it and case bonded to its inside walls. A pyrotechnic igniter 23 extends into the central bore of propellant grain 22, and is electrically connected to an arm/firing device 24 which is electrically connected through wiring harness 27 to a power source on the launch vehicle. Arm/firing device 24 acts to block the electric charge from reaching igniter 23 thereby preventing igniter 23 from discharging until the proper time.

Propellant grain 22 can be of a type such as a non-aluminized or aluminized hydroxy-terminated polybutadiene (HTPB) propellant that has been used in past test firings. Such propellants have a broad technical base and enjoy widespread use throughout the propulsion industry.

A nozzle throat 25 can be made of graphite, tungsten, molybdenum or various carbibes to better withstand the high temperatures or corrosive effects of the burning of propellant grain 22. Throat 25 is build upon a nozzle base 26, which can be of a less expensive, phenolic-type material.

A thrust termination port 28 is incorporated and acts to reverse the thrust of rocket motor 20 and back booster 15 away from the guided missile. Port 28 is fired in conjunction with an explosive clamp 38 (see FIG. 4) that acts to securely hold booster 15 adjacent the aft end of missile 10. Clamp 38 completely encircles booster 15 and missile 10, fitting tightly into a clamp groove 39 which serves as in interface around the forward end of booster 15 and into a similar groove around the aft end of missile 10. Clamp 38 can be a Marmon clamp or other similar clamp known in the industry.

Figure 4:
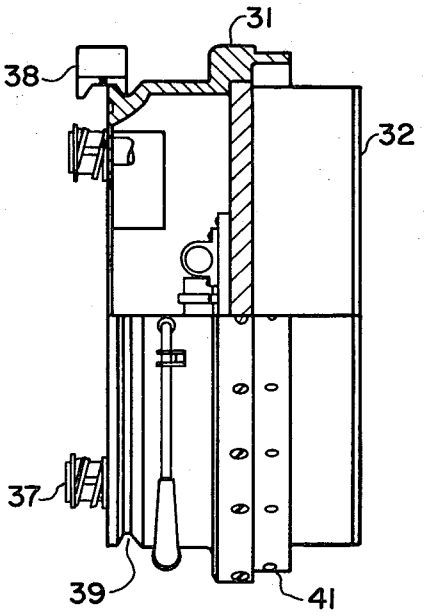
FIG. 4 is a side view of the BGU with a partial cut-away of the housing.
Figure 3:
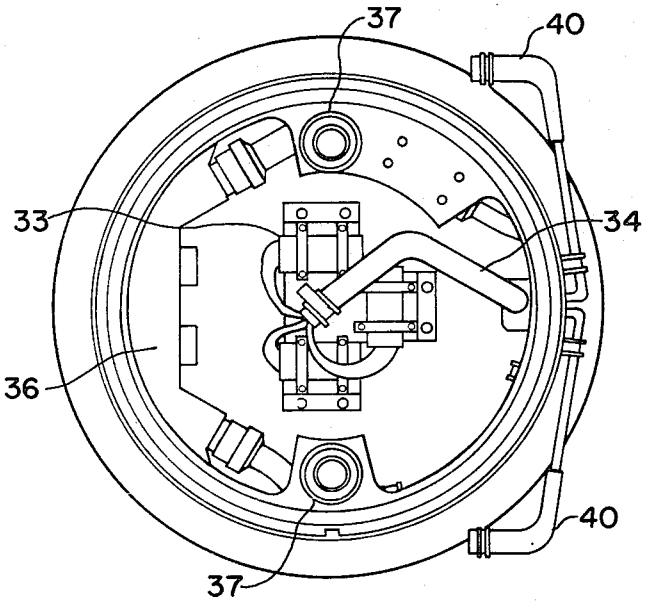
FIG. 3 is a forward end view of the booster shown in FIG. 2.

As shown in FIGS. 3 and 4, BGU 30, which is built inside a cylindrical housing 31 that interfaces with the aft end of missile 10 at clamp groove 39, has a complete and independent autopilot 32. Autopilot 32 has a sensor package 33 which includes three rate gyroscopes to sense launch vessel pitch, yaw, and roll and any missile in-flight angular motion. It can also incorporate an accelerometer package to provide position data if necessary. Sensor package 33 is connected to autopilot 32 through a connection 34, and connectors 37 act to interface the MGU, autopilot 32 and the launch vessel's fire control system.

BGU 30 will provide guidance and control during the boost phase of the missile's flight as well as compute the trajectory solution and in-flight control parameters, using a microprocessor as its central processing unit, and provide missile-booster interlock status functions. BGU 30 uses a direction cosine computational algorithm, such as is disclosed in U.S. Pat. No. 3,803,387 to Donald H. Lackowski and assigned to the United States of America as represented by the Secretary of the Navy and which is hereby incorporated by reference, to determine missile attitude and TVC commands.

Finally, in order to meet all power requirements of BGU 30, a thermal battery 36 is located adjacent to the inner wall of unit 30 to supply boost phase power. Battery 36 provides +28 VDC regulated to +5 VDC to run the logic circuits of autopilot 32. The battery power is also converted to the 400 Hz AC power required for the rate gyros of sensor package 33.

Figure 6:
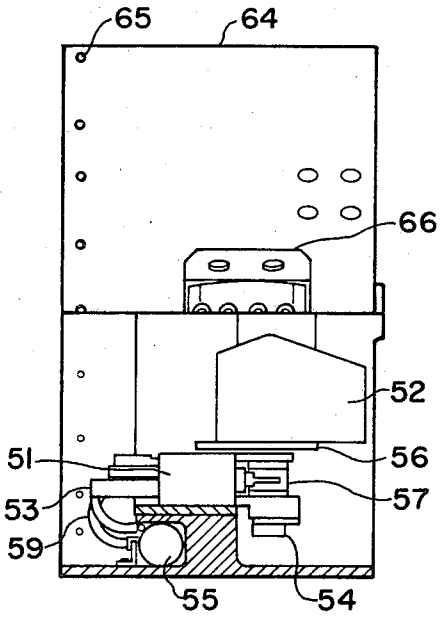
FIG. 6 is a side view of the TVC unit with a partial cut-away of the cover.
Figure 5:
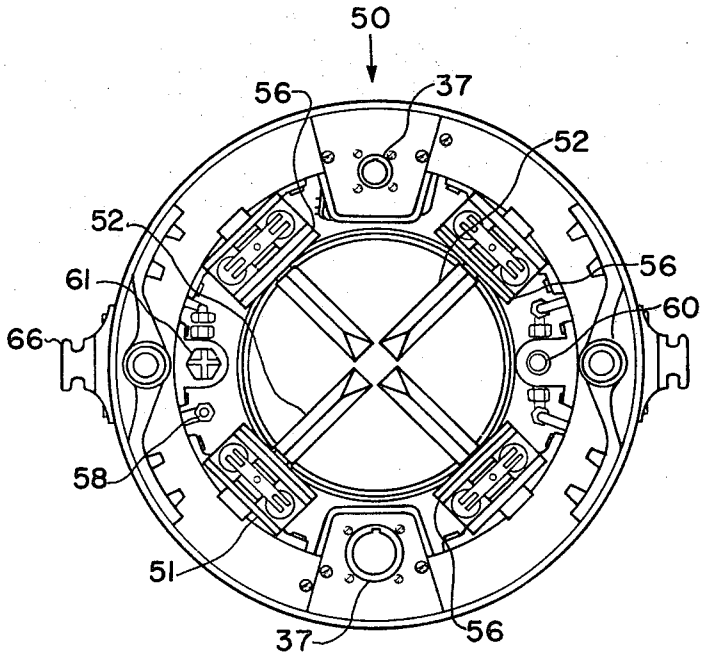
FIG. 5 is an aft view taken of the booster.
Figure 7:
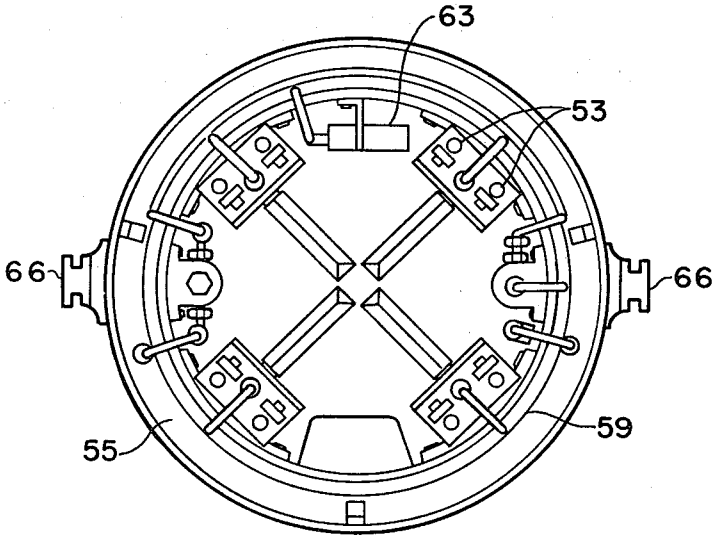
FIG. 7 is a cross-sectional view taken along lines VII—VII of FIG. 2.

Referring now to FIGS. 5, 6, and 7, module 50 which is contained inside a TVC cover 64 contains a plurality of pneumatically driven actuators 51, four in the illustrated embodiment, which each move one of four jet vanes 52. Cover 64 is of a tubular design and acts to transfer the jet vane-generated loads to booster 15. Actuators 51 each consist of two single-stage flapper control valves 53 (see FIG. 7), and a push-push type control unit (not shown) as are commonly used in the art. Flapper valves 53 are proportionately controlled using a pulse width modulated 100 Hz electrical signal received from autopilot 32 and, in turn, control the push-push unit with 1000 psi of a regulated gas. Each actuator 51 has a feedback potentiometer 54 which rests on each jet vane shaft 57. Potentiometer 54 is a rotary-type potentiometer which feeds an electrical difference to autopilot 32. Voltage ranges correspond to positions of jet vanes 52.

A heatshield 56 is attached to the outer end of each of jet vanes 52, and serves to protect actuators 51 from exhaust gases. Each jet vane 52 is shaped as an aerodynamic foil that directs the exhaust gases from module 20. Jet vanes 52 are made from a refractory material, such as copper-infiltrated tungsten or a ceramic-coated stainless steel, or other materials using techniques well known in the industry.

The pressurized gas to power actuators 51 is stored in a toroidal tank 55 which extends around the inside of module 50 (see FIG. 7). A filter valve 58 allows the pressurized gas to be pumped into tank 55, and a pressure regulator 61 is mounted on the inside of module 50, and it serves to regulate the nitrogen or other inert gas to the appropriate pressure to move actuators 51. An explosive valve 60 is mounted inside of module 50, equidistant between two jet vanes 52, and when activated by a command from the fire control system, opens the flow of the pressurized gas to actuator 51. A pressure switch 63 monitors the amount of pressure in tank 55, and is electrically connected to autopilot 32. Pressure switch 63 signals autopilot 32 that there is pressure in tank 55 and that it is above a safe, predetermined level. As an alternate to a high pressure gas system, a hydraulic system can be used to move actuators 51. In this instance, a gas generator would be used to produce enough gas to power the liquid.

Obviously, many modifications and variations of the present invention are possible in the light of the above teachings, and, it is therefore understood that, within the scope of the disclosed inventive concept, the invention may be practiced otherwise than specifically described.

What is claimed is:

1. An apparatus for apogee-controlled launch of a guided missile comprising:

boost means for variably controlling said guided missile at launch having fore and aft ends with a thrust termination port in the aft end of said boost means;

clamping means for removably attaching said boost means' fore end to the aft end of said guided missile, said clamping means sequentially connected to said thrust termination port such that after said clamping means releases said thrust termination port is activated;

a rocket motor and propellant fixedly housed inside said boost means for providing thrust to said guided missile;

a pneumatically actuated jet vane thrust vector control unit made of copper-infiltrated tungsten positioned aft of said rocket motor and propellant and inside the aft end of said boost means for variably directing the rocket motor exhaust gases; and a boost guidance unit mounted within said boost means for guiding said missile and comprises:

a sensor package with at least three rate gyroscopes for sensing any pitch, yaw, and/or roll;

a central processing unit inputting said sensor information for computing in-flight control parameters; and an autopilot connected to said central processing unit's output for executing said in-flight control parameters.

* * * * *